US007690133B2

(12) United States Patent
Olivieri

(10) Patent No.: US 7,690,133 B2
(45) Date of Patent: Apr. 6, 2010

(54) SHOE, IN PARTICULAR FOR A CHILD

(75) Inventor: Oliviero Olivieri, Moniebelluna (IT)

(73) Assignee: Kellismere LLC, Cheyenne, WY (US)

( * ) Notice: Subject to any disclaimer, the term of this patent is extended or adjusted under 35 U.S.C. 154(b) by 318 days.

(21) Appl. No.: 11/456,009

(22) Filed: Jul. 6, 2006

(65) Prior Publication Data

US 2007/0011916 A1 Jan. 18, 2007

(30) Foreign Application Priority Data

Jul. 6, 2005 (EP) ..... 05014640

(51) Int. Cl.
*A43B 3/26* (2006.01)
*A43B 3/28* (2006.01)

(52) U.S. Cl. ..... 36/97; 36/155; 36/112

(58) Field of Classification Search ..... 36/43, 36/97, 155, 159–163, 31, 100, 30 R, 112
See application file for complete search history.

(56) References Cited

U.S. PATENT DOCUMENTS 1,633,413 A * 6/1927 La Marca ..... 36/91
1,733,678 A * 10/1929 Torchia ..... 36/164
5,570,523 A 11/1996 Lin
6,092,311 A * 7/2000 MacNamara ..... 36/97
6,374,515 B1 4/2002 Davis
6,408,543 B1 * 6/2002 Erickson et al. ..... 36/100
6,442,874 B1 9/2002 Long
6,748,676 B1 * 6/2004 Chenevert ..... 36/115
6,922,919 B2 * 8/2005 Chenevert ..... 36/115
7,210,250 B2 * 5/2007 Gallegos ..... 36/44
2002/0083618 A1 7/2002 Erickson et al.
2004/0103561 A1 * 6/2004 Campbell et al. ..... 36/88
2004/0200099 A1 10/2004 Chenevert
2005/0050772 A1 * 3/2005 Miller et al. ..... 36/97
2006/0107552 A1 * 5/2006 Clark et al. ..... 36/97
2006/0107553 A1 * 5/2006 Clark et al. ..... 36/97
2008/0127518 A1 * 6/2008 Byrne et al. ..... 36/97

FOREIGN PATENT DOCUMENTS

DE 17 10 421 U 11/1955
DE 86 04 180 U1 5/1987
GB 141 425 A 4/1920

* cited by examiner

*Primary Examiner*—Marie Patterson
(74) *Attorney, Agent, or Firm*—Akerman Senterfitt

(57) ABSTRACT

Shoe (10), in particular for a child, which advantageously has an unusually long lifetime, is of the type comprising a sole (12) and a upper (14), that define a determined fitting volume (V2), in which a determined length (L2) and a determined fitting (C2) are individualized, said shoe (10) comprising at least one removable, fittable spacer (20), which determines a reduced fitting volume (V1), in which a reduced length (L1) and a reduced fitting (C1) are individualized with respect to said determined length (L2) and said determined fitting (C2), respectively.

8 Claims, 5 Drawing Sheets

SHOE, IN PARTICULAR FOR A CHILD

FIELD OF APPLICATION

The present invention, in its most general aspect, refers to a shoe.

In particular, the invention refers to a shoe for a child, comprising a sole and a upper, that define a determined fitting volume, in which a determined length and a determined fitting are individualized.

PRIOR ART

It is known that, for a correct deambulation, there is the requirement of avoiding:

- shoes that are too tight, since they alter the blood circulation in the foot, favour the soaking of it and prevent the natural mobility of the toes;
- shoes that are too loose, since, due to the rubbing of the foot inside the shoe itself, they can cause blisters and calluses;
- shoes already previously worn by others, since, having been adapted to another foot, they can injure the soft parts of the foot and frequently one falls into one of the aforementioned two cases.

In particular, as far as children's and adolescent's shoes are concerned, where the foot grows very quickly above all in the first years of life, podiatrists advise to frequently check that the size of the shoes is suitable. For example, the checking frequency, with possible replacement of shoes that are too tight with the next size up, can be:

- for a child of 1 to 3 years of age, every two months
- for a child of 3 to 6 years of age, every four months
- for a child of 6 to 10 years of age, every six months
- for a child/adolescent of 10 to 15 years of age, every eight months.

In the present invention reference shall be made to shoe, in particular for a child, of the type comprising a sole and a upper, which individualize a determined fitting volume, in which a determined length and a determined fitting are individualized.

It must be specified that, in the technical jargon of the field of shoes, the distance between a front end, or toe, of the fitting volume and a rear end, or heel, of the fitting volume is defined as the length, and that the distance between sole and upper, measured in substantially perpendicular manner to the sole at a determined zone between said toe and said heel, is defined as the fitting.

More specifically, as is well known to the person skilled in the art, the aforementioned zone at which the fitting is measured is, approximately, the zone where the metatarsal bones of the foot are situated.

The aforementioned shoes, above all when the fitting volume is substantially closed between the toe and the heel, should be replaced with a pair of the next size up as soon as they become too short for the child's foot, so as not to fall into the aforementioned case of "too tight shoes".

More specifically, the set of the values of length and fitting characterizes a determined fitting volume, which corresponds to a determined shoe size.

Shoe sizes have been the object of standardization rules, so that for some time there have been a series of internationally recognized sizes: in other words, a discreet set of sizes has been defined in which the difference between one size and the next is such that it is always possible to find a shoe that is neither "too tight", nor "too loose".

Although advantageous from various points of view, a shoe structured in the way schematically described above has recognized drawbacks, the first of which is linked to the fact that, in the case of shoes for a child, they must be replaced very frequently, i.e. many times the shoes are replaced when are still in good condition, having been used by the child for a very short time.

SUMMARY OF THE INVENTION

The technical problem forming the basis of the present invention is that of devising and providing shoes—in particular for a child—of the type considered, capable of satisfying the requirement outlined above, at the same time allowing the frequency of replacement of the shoes to be reduced, so as to overcome the quoted limitations and drawbacks with reference to the prior art, in a simple and cost-effective manner.

This problem is solved, according to the present invention, by a shoe, in particular for a child, comprising a sole and a upper, that define a determined fitting volume, in which a determined length and a determined fitting are individualized, characterized in that it comprises at least one removable, fittable spacer, which determines a reduced fitting volume, in which a reduced length and a reduced fitting are individualized with respect to said determined length and said determined fitting, respectively.

Further characteristics and the advantages of the shoe, in particular for a child, according to the present invention shall become clearer from the following description of a preferred embodiment thereof, given for indicating and not limiting purposes, with reference to the attached figures.

DETAILED DESCRIPTION OF A PREFERRED EMBODIMENT

Figure 1:
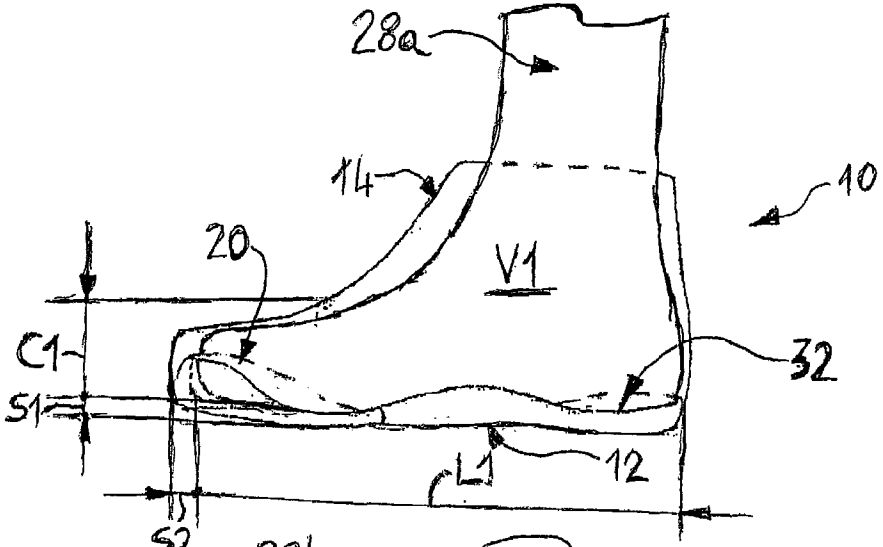
FIG. 1 schematically represents a section view in side elevation of a shoe according to the present invention, in a first configuration.

With initial reference to FIGS. 1, 2, 3 and 4, a shoe, in particular for a child, is shown, in accordance with the present invention and wholly indicated with 10.

The shoe 10 comprises a sole 12 and a upper 14, that define a determined fitting volume V2, in which a determined length L2 and a determined fitting C2 are individualized.

More specifically, the distance between a front end 15, or toe, of the fitting volume V2 and a rear end 18, or heel, of the fitting volume V2 is defined as the length L2. The distance between sole 12 and upper 14, measured in substantially perpendicular manner to said sole 12 at a determined zone between said toe 16 and said heel 18, is defined fitting C2.

In particular, in accordance with a characterizing aspect of the present invention, such shoe 10 comprises a removable, fittable spacer 20, which determines a reduced fitting volume V1, in which a reduced length L1 and a reduced fitting C1 are individualized with respect to said determined length L2 and said determined fitting C2, respectively. Preferably, the fittable spacer 20 is placed at least at said toe 16 of the fitting volume V2.

It should be specified that, in the present application, by fittable spacer 20 it is meant a spacer that is shaped so as to be able to be worn by at least a part of the foot, for example by a front part of the foot.

More specifically, the removable, fittable spacer 20, substantially hull-shaped, comprises a sole portion 22 and a toe portion 24 and can be positioned, inside the shoe 10 and above the sole 12, at the toe 16 of the fitting volume V2.

The sole portion 22 has a curvilinear front profile 26, shaped according to the profile of the front portion of the sole 12, and has a predetermined, approximately constant, thickness S1.

The toe portion 24 is connected in a substantially perpendicular manner to the sole portion 22 at the front profile 26 of the sole portion 22 itself and has a predetermined, approximately constant, thickness S2.

Figure 2:
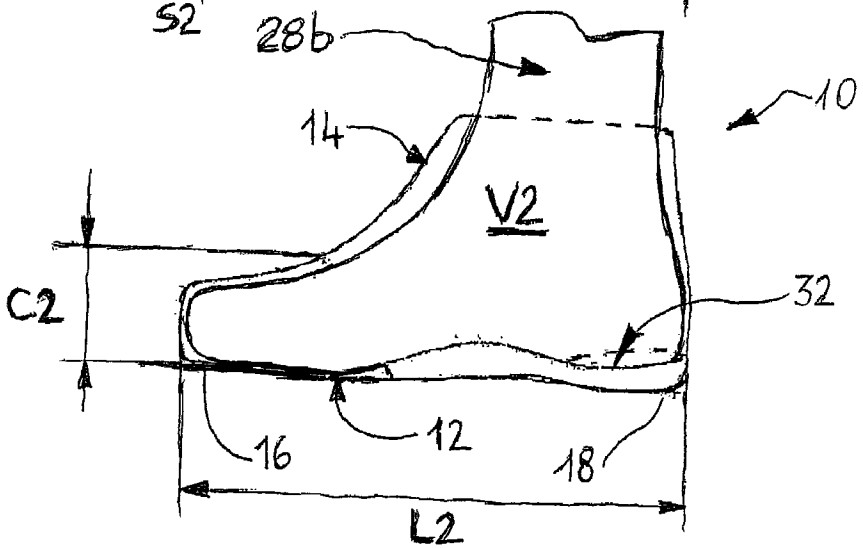
FIG. 2 schematically represents a section view in side elevation of a shoe according to the present invention, in a second configuration.
Figure 4:
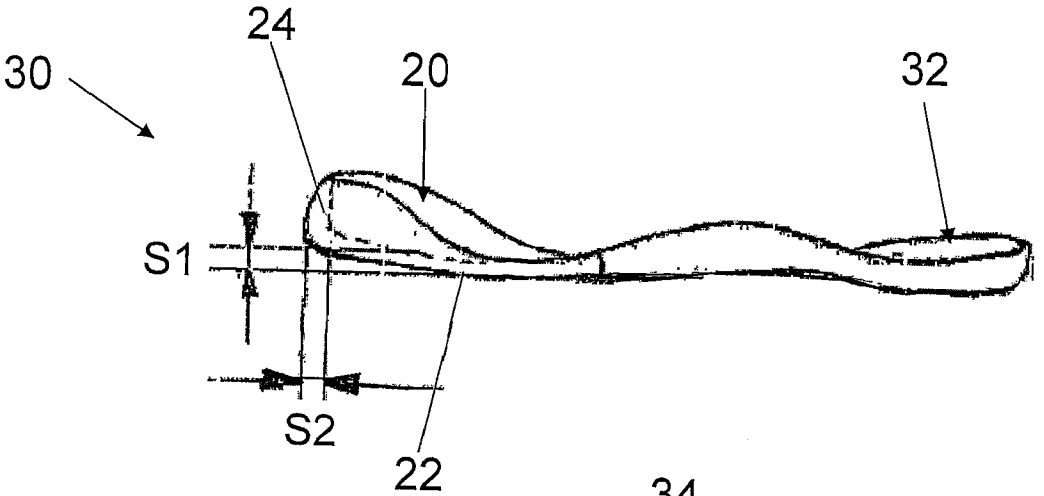
FIG. 4 schematically represents a view in side elevation of the shoe component of FIG. 3.
Figure 3:
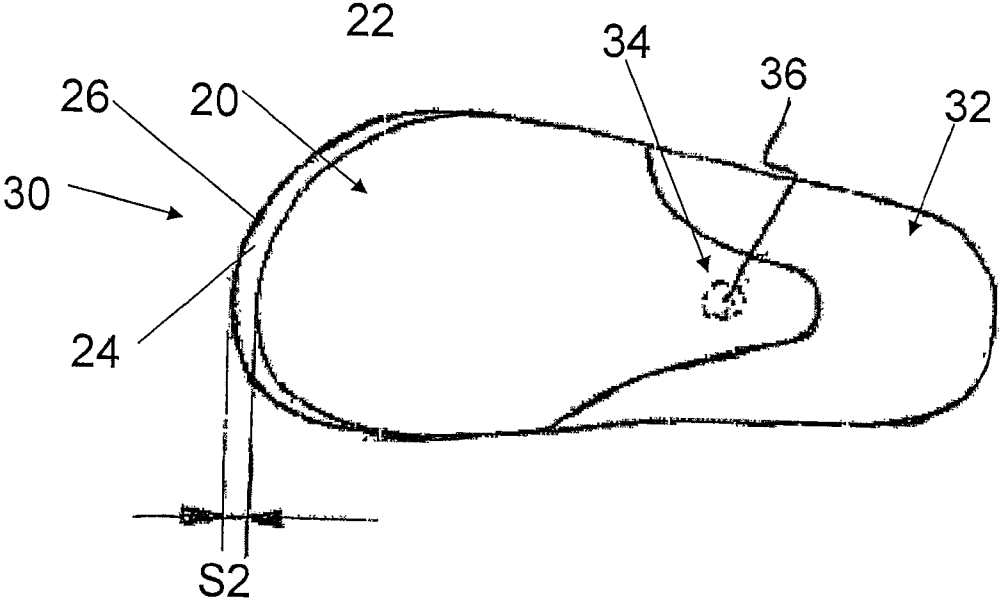
FIG. 3 schematically represents a plan view from above of a component of the shoe of FIG. 1.
Figure 7:
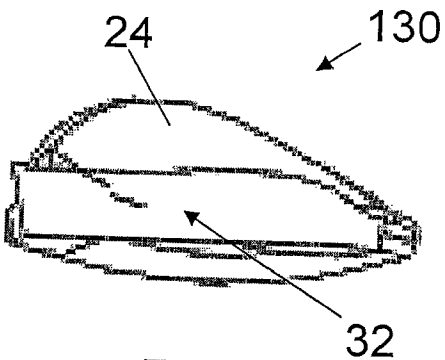
FIG. 7 schematically represents a further view in side elevation of the component of FIG. 5.
Figure 6:
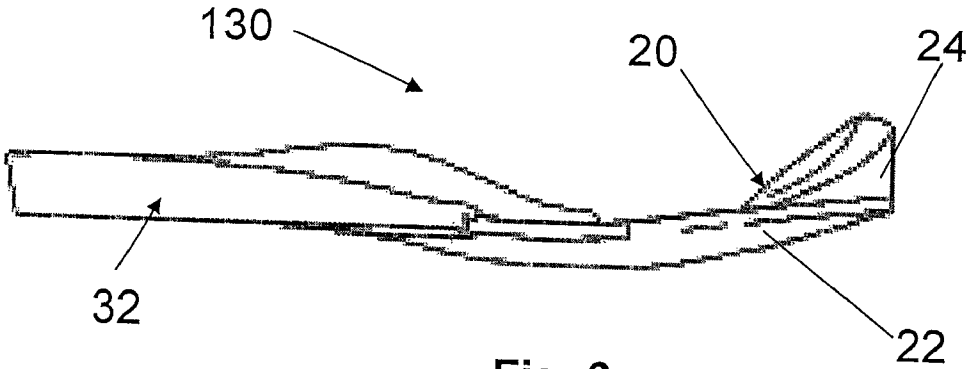
FIG. 6 schematically represents a view in side elevation of the component of FIG. 5.
Figure 5:
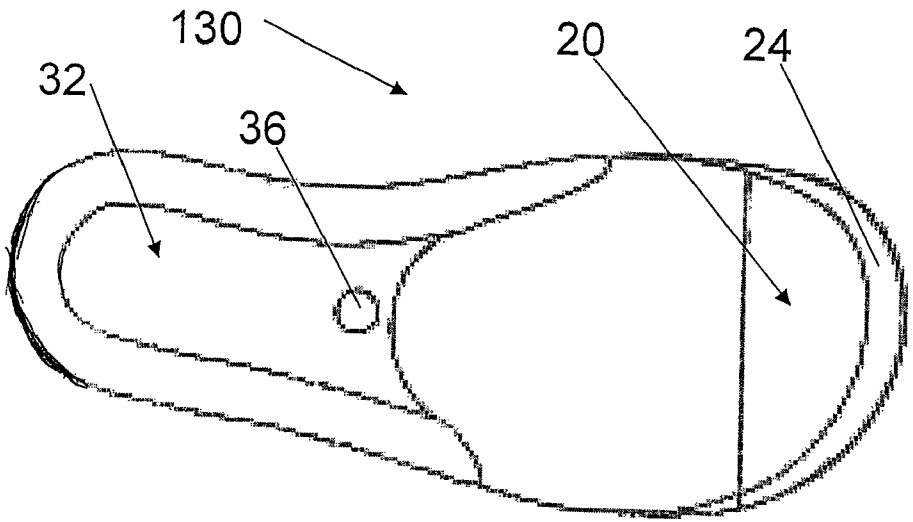
FIG. 5 schematically represents a plan view from above of a second embodiment of the component of FIG. 3.
Figure 8:
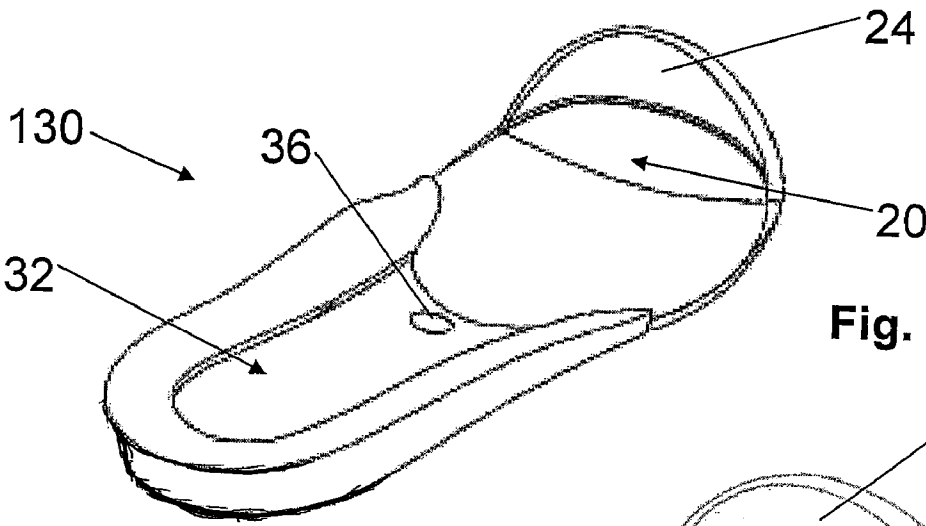
FIG. 8 schematically represents a perspective view of the component of FIG. 5.
Figure 10:
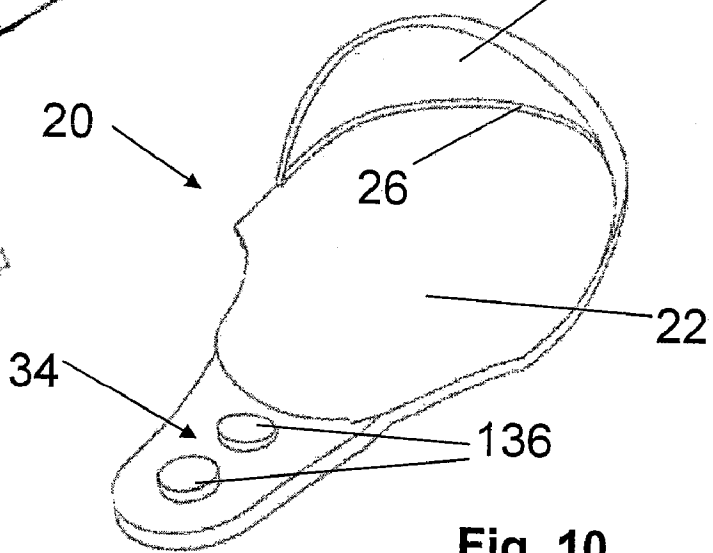
FIG. 10 schematically represents an enlarged perspective view of a front part of the component of FIG. 8.
Figure 9:
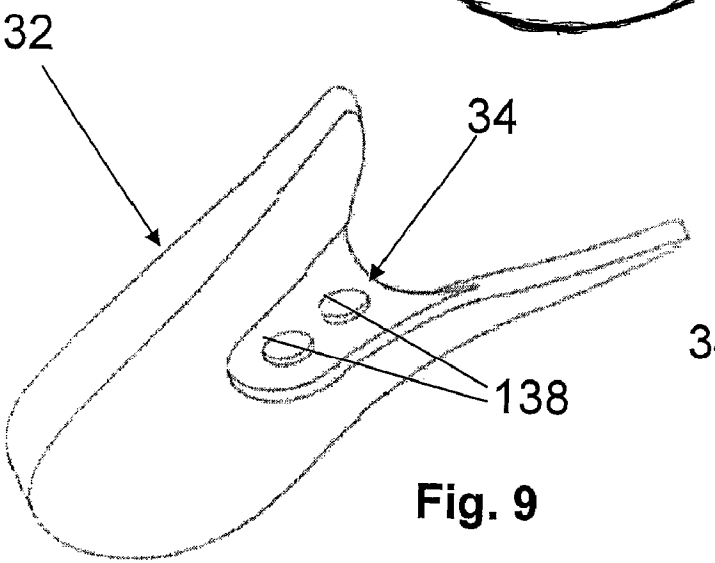
FIG. 9 schematically represents an enlarged perspective view of a rear part of the component of FIG. 8, overturned with respect to the view of FIG. 8.

FIG. 1 shows a first configuration of the shoe 10 that is provided with the fittable spacer 20, said shoe 10 being worn by a foot 28*a* of a determined size (i.e. characterized by a length L1 and a fitting C1). FIG. 2 shows a second configuration of the shoe 10 in which the fittable spacer 20 has been removed, said shoe 10 being worn by a foot 28*b* of a greater size than that of the foot 28*a*. More specifically, the size of the shoe 10 of FIG. 2 is characterized by a length L2 equal to the aforementioned length L1 plus the thickness S2 of the toe portion 24 of the fittable spacer 20, and by a fitting C2 equal to the aforementioned fitting C1 plus the thickness S1 of the sole portion 22 of the fittable spacer 20. In other words, by taking away the fittable spacer 20, the length and fitting are increased with respect to the configuration of FIG. 1 so as to obtain a length and a fitting corresponding to those of a shoe of greater size.

Preferably, the size of the shoe 10 of FIG. 2 exactly corresponds to the next size up from the shoe of FIG. 1. For example, by taking away the fittable spacer 20, one goes from the size "26" to the size "27".

In a first embodiment, shown in FIGS. 1, 2, 3 and 4, the removable, fittable spacer 20 is part of a insole 30 positioned, inside the shoe 10, above the sole 12 and substantially shaped according to the profile of the sole 12 itself.

The fittable spacer 20 constitutes a front part of the insole 30, a rear part 32 of the insole 30 being removably joined to the fittable spacer 20 through fastening means 34, such as a button fastener 36 (illustrated in FIG. 3), a dovetail fastener, a Velcro® fastener, a glue or similar. Preferably, said fastening means 34 are provided on the sole portion 22 of the fittable spacer 20, on the opposite side to the front profile 26 of the fittable spacer 20 itself.

As shown in FIG. 2, the rear part 32 of the insole 30 remains positioned in the rear part of the sole 12 even after the removal of the fittable spacer 20: for this purpose, the rear part 32 of the insole 30 is for example glued to the rear part of the sole 12.

Advantageously, the insole 30 can be made from a material such as to allow the absorption of the impacts of the foot on the ground, for example an expanded material.

It should also be noted that the insole can have an anatomical conformation to improve the comfort of the foot.

Preferably, the insole 30 comprises an upper covering layer, for example made from leather, with the function of foot-strap, substantially shaped according to the profile of the insole 30 and joined to just the rear part 32 of the insole 30 itself: when the fittable spacer 20 is taken away, a front part of the upper covering layer rests directly over the front part of the sole 12.

Advantageously, the upper covering layer, and possibly also the insole, can be perforated to ensure a determined degree of transpiration.

FIGS. 5, 6, 7, 8, 9 and 10 show a second embodiment of an insole according to the present invention, wholly indicated with 130, where the elements functionally analogous to those of the insole 30 are indicated with the same reference numerals.

In particular, the fastening means 34 comprise two button fasteners, i.e. on the sole portion 22 of the fittable spacer 20, at the opposite side to the front profile 26 of the fittable spacer 20 itself, a couple of projections 136 is provided, suitable for being inserted in a corresponding couple of recesses 138 provided in the rear part 32 of the insole 130.

Figure 12:
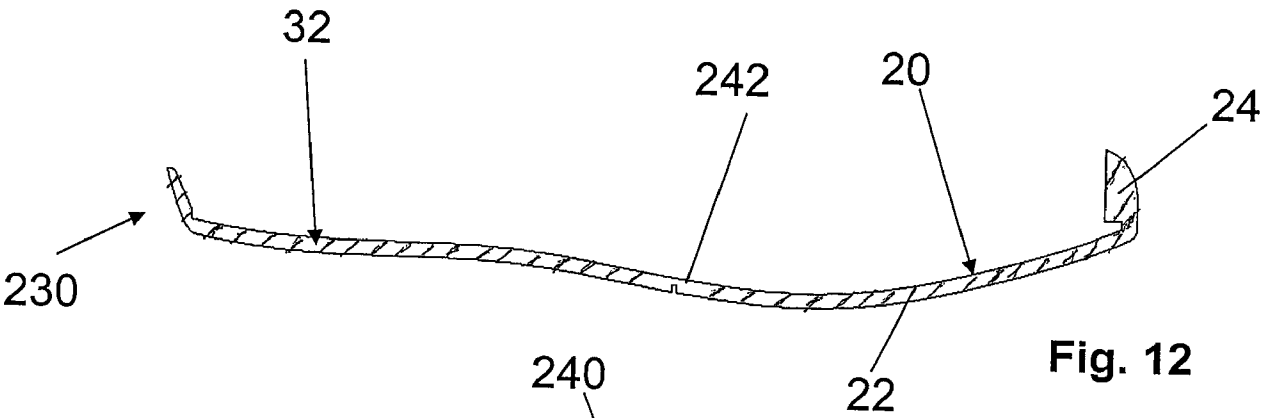
FIG. 12 schematically represents a section view in side elevation of the component of FIG. 11, taken according to the traced plane XII-XII of FIG. 11 itself.
Figure 11:
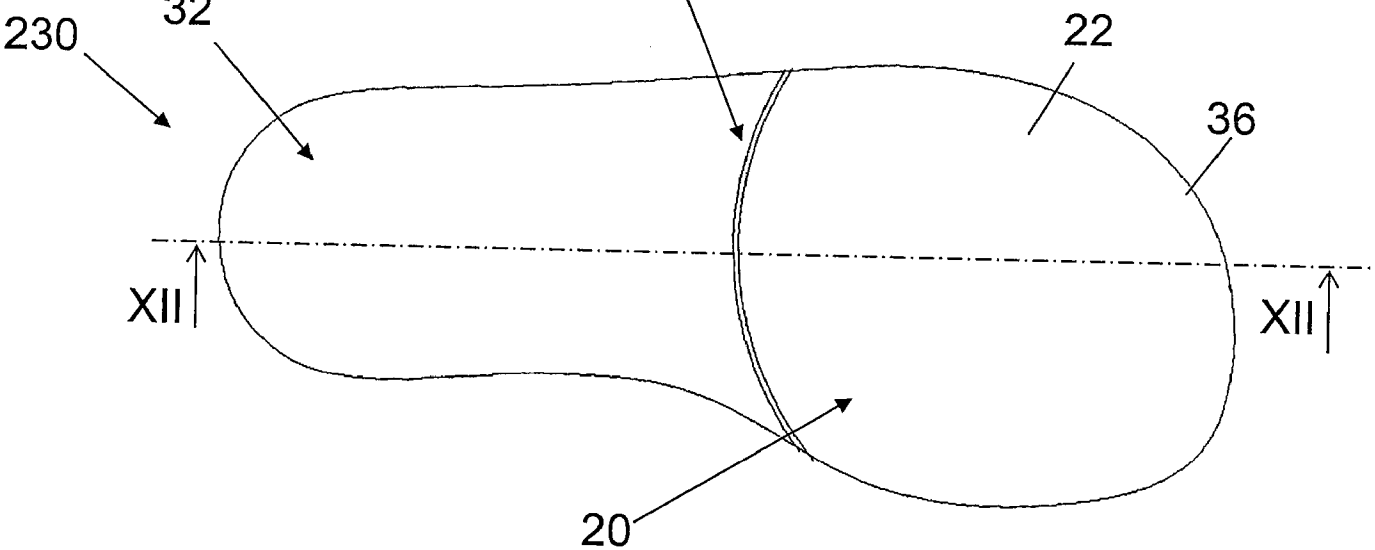
FIG. 11 schematically represents a plan view from above of a third embodiment of the component of FIG. 3.

FIGS. 11 and 12 show a third embodiment of an insole according to the present invention, wholly indicated with 230, where the elements functionally analogous to those of the insole 30 are indicated with the same reference numerals.

In particular, this embodiment provides that the sole portion 22 of the fittable spacer 20 is joined to the rear part 32 of the insole 230 through rip-away detachment means 240. Said means 240 comprise, for example, a portion 242 whit thin thickness that can be ripped even manually, obtaining the separation between the rear part 32 of the insole 230, which remains positioned in the shoe, and the fittable spacer 20, which is taken away.

In alternative embodiments of the present invention, the shoe can comprise a plurality of removable, fittable spacers, which determine a reduced fitting volume, in which a reduced length and a reduced fitting are individualized with respect to said determined length and said determined fitting, respectively.

In other words, the removable, fittable spacer 20 described above with reference to the attached figures can be made in many parts: for example, the sole portion 22 and the toe portion 24 described above can be mutually distinct portions. Otherwise, two, or more, fittable spacers of the type described above can be provided, placed on top of each other, individually removable, so that the shoe has three, or more, different lengths and fittings, i.e. it corresponds to three, or more, successive sizes: in practice, the spacers are "worn" one on top of the other, and are taken away as the foot grows.

The present invention also refers to a removable, fittable spacer of the aforementioned type, as well as to the aforementioned insole including the aforementioned removable, fittable spacer.

Indeed, it should be noted that the aforementioned insoles, and the aforementioned fittable spacers, can also be commercialized separately from the shoes.

From the previous description it can clearly be seen that the shoe according to the invention solves the technical problem and achieves numerous advantages the first of which lies in the fact that, in the case of children's shoes, the lifetime of a single shoe is unusually increased, i.e. the same shoe can be used for longer, with it initially having a determined size and then, removing the fittable spacer, having the next size up.

In other words, in the case of children's shoes, with the shoe of the present invention, it is possible, at the minimum, to halve the number of shoes bought during the child's growth.

Of course, a person skilled in the art can bring numerous modifications and variants to the shoe described above in order to satisfy specific and contingent requirements, all of which are in any case covered by the scope of protection of the present invention, as defined by the following claims.

The invention claimed is:

1. A shoe comprising:

a sole;

an upper part defining a given length and fitting of the shoe; and an insole positioned above said sole and substantially shaped according to the profile of the sole, said insole comprising a rear part fixed to said sole and at least one removable front spacer, wherein said removable front spacer comprises a sole portion and a toe portion, said removable spacer being removably joined to a rear part of the insole to provide a reduced length and fitting of the shoe.

2. The shoe according to claim 1, wherein said removable spacer has a sole portion with a curvilinear front profile according to the profile of the front portion of the sole, and has a predetermined and approximately constant thickness.

3. The shoe according to claim 1, wherein said removable spacer is joined to the rear part of the insole by fastening means.

4. The shoe according to claim 3, wherein said fastening means comprises two button fasteners comprising a couple of projections on the sole portion of the removable spacer suitable for insertion in a corresponding couple of recesses of the rear part of said insole.

5. The shoe according to claim 1, wherein said removable spacer is separable from said rear part of the insole through rip-away detachment means.

6. The shoe according to claim 1, wherein said insole is made of a material that allows the absorption of the impacts of the foot on the ground.

7. The shoe according to claim 1, wherein said insole comprises an upper covering layer, shaped according to the profile of the insole and joined to just the rear part of the insole.

8. The shoe according to claim 1, comprising a plurality of removable spacers.

* * * * *